United States Patent [19]

Jürgens

[11] Patent Number: 4,499,563

[45] Date of Patent: Feb. 12, 1985

[54] APPARATUS FOR TRANSMITTING DATA FROM A BOREHOLE TO THE SURFACE OF THE EARTH DURING THE OPERATION OF A DRILLING DEVICE

[75] Inventor: Rainer Jürgens, Altencelle, Fed. Rep. of Germany

[73] Assignee: Christensen, Inc., Salt Lake City, Utah

[21] Appl. No.: 361,704

[22] Filed: Mar. 25, 1982

[30] Foreign Application Priority Data

Apr. 4, 1981 [DE] Fed. Rep. of Germany ..... 3113749

[51] Int. Cl.[3] ..... G01V 1/40

[52] U.S. Cl. ..... 367/84; 175/48

[58] Field of Search ..... 367/81–83, 367/84; 73/151; 175/45, 107, 48; 181/106

[56] References Cited

U.S. PATENT DOCUMENTS 2,898,084 8/1959 Eckel et al. ..... 367/82

3,004,613 10/1961 Murphey ..... 175/45

4,078,620 3/1978 Westlake et al. ..... 367/83

*Primary Examiner*—Nelson Moskowitz

*Assistant Examiner*—K. R. Kaiser

*Attorney, Agent, or Firm*—Rufus M. Franklin

[57] ABSTRACT

An apparatus for the remote transmission of information from a borehole (1) to the surface of the earth is disposed in a drilling pipe string (4) of a drilling device. The drilling device further comprises a rotary drill bit (3) and a pump (5) which pumps the flushing liquid (6) downwards in the flow passage (11) of the drilling pipe string, through the rotary drill bit (3) and upwards in an annular space (7) surrounding the pipe string. The apparatus has devices for ascertaining information data (8), for converting the information data into electrical control signals (9) and for producing pressure pulses (10) in the downwardly directed flow of the flushing liquid (6). The devices are disposed in a chamber (13) which is bounded internally by the flow passage (11) and externally by an outer tube (12).

4 Claims, 8 Drawing Figures

APPARATUS FOR TRANSMITTING DATA FROM A BOREHOLE TO THE SURFACE OF THE EARTH DURING THE OPERATION OF A DRILLING DEVICE

The invention relates to an apparatus for transmitting data from a borehole to the surface of the earth during the operating of a drilling device.

During deep-well drilling, it is of considerable importance to obtain data from the borehole regarding the course of the drilling work which enables measures to be taken in good time to optimize the drilling operation and to counteract faults or irregularities which occur.

In the past, numerous attempts have been made and proposals put forward to ascertain the particular data required from more or less the bottom of the borehole and to transmit it to the surface of the earth. In this case, the apparatus with its devices for ascertaining the data, for converting the data into electrical control signals and for producing the pressure pulses and the electrical energy needed is installed appropriately close to the drill bit in the drilling pipe string.

If it happens during the drilling operation that parts of the drilling pipe string, such as the drill bit, drill stems or stabilizers, jam in the borehole and all efforts to free the drilling pipe string or the drill bit prove to be in vain, then the stationary parts of the drilling pipe string are lost with the drill bit.

The sections of the drilling pipe string situated above can generally only be recovered from the section, the lower threaded connection of which is freely accessible for the positioning of an explosive charge and can be released by igniting the explosive charge, a moment effective in the unscrewing direction being applied.

Apparatus for the transmission of data as previously proposed hinder this free access so that the release of the threaded connections below the pipe string section housing the apparatus is not possible by the above method. The sections with the equipment, some of which is very valuable, had to be either abandoned or could only be recovered by very complicated, time-consuming collecting work.

Furthermore, direct drives for bits and core tubes are usual which comprise a by-pass passage and are controlled by a valve body located in the flow passage from above.

Free access to the lower sections of the drilling pipe string is therefore not only desired in the case of a jammed portion of the string; it may also be essential for proper operation of certain drilling tools.

It is an object of the present invention to provide improved data transmitting apparatus.

The present invention is apparatus for transmitting data from a borehole to the surface of the earth during the operation of a drilling device which comprises a rotary drill bit, a drilling pipe string and a pump conveying a flushing liquid downwards in the flow passage of the drilling pipe string, through the rotary drill bit and upwards in the annular space of the borehole surrounding the drilling pipe string, the apparatus comprising devices disposed in the drilling pipe string to ascertain the required data, to convert the data into a sequence of electrical control signals, and to produce pressure pulses in the downwardly directed flow of the flushing liquid, depending on the control signals, said devices being disposed inside a chamber surrounding the flow passage of the drilling pipe string and bounded on the outside by an outer tube.

With this arrangement, the flow passage can extend as a straight central tube of constant diameter inside the section of the drilling pipe string which comprises the apparatus for the transmission of data, as in the other sections of the drilling pipe string.

The diameter of the tubes depends on the usual value for the particular tool diameter so that auxiliary devices, which are lowered through the flow passage, cannot become hooked as a result of a discontinuity.

The housing of the apparatus does not require special parts which are expensive to manufacture. Semi-finished products, such as are usual for other tools in the deep-drilling art, can be used as outer tubes for example. If parts which are particularly stressed mechanically, such as threaded connections for example, are damaged, the apparatus can be repaired by simple exchange of the outer tube.

As a result of coaxial symmetry in the construction of the apparatus, the same characteristics result, with regard to a maximum bending load capacity independent of direction as with other tools disposed in the drilling pipe string.

An installation chamber for accommodating sensitive electronic components can be provided by an insert which can be inserted in the outer tube. The installation chamber is bounded towards the flow passage by a wall, towards the annular space by the outer tube and at the end by cylindrical members which bear against the outer tube with a sealing action. The cylindrical members are suitable, at the same time, as centering members and as axial stops, for example against constrictions of the outer tube to the thread transition or against threaded shoulders of adjacent lengths of outer tube.

The installation chamber can be adapted in shape to the parts of the equipment to be received. Thus tubular chambers with a circular cross-section are suitable to receive large volume cylindrical components, for example batteries or capacitors, because they can hold the components laterally at the same time. Printed circuit boards, on the other hand, need the widest possible chambers with a rectangular cross-section and webs for securing.

Since the outer boundary of the installation chamber is formed by the outer tube, the structural elements are freely accessible with the insert withdrawn. For maintenance, adjusting and test work, therefore, the apparatus is fully capable of operation even without the outer tube and easy to handle because of the absent weight of the outer tube.

For an electrical connection between two or more inserts, a connecting chamber may be necessary which should possibly also be able to be sealed off.

The connecting chamber can be given a diameter reduced in comparison with the diameter of the outer tube by means of extensions or sleeves, the extensions or tubes fitting into their counter member. The connecting chamber can also be hermetically sealed off from the flow passage by seals disposed at the contact surfaces.

If the connecting chamber is situated outside a threaded connection of the outer tube, then the cylindrical members of the inserts are available as carriers for sealing against the threaded connection. In addition, the lengths of outer tube may also be mutually sealed towards the threaded region. They must be sealed if the inner threaded shoulder lies inside the connecting chamber.

The region of the apparatus which produces the pressure pulses in the flow of the flushing liquid is constructed in the form of a controllable valve, the drive and valve elements of which are likewise accommodated in the space between flow passage and outer tube.

In the case of a valve for producing drops in pressure, there is a by-pass passage from the flow passage to the annular space, which leads partially through a displaceable and/or rotatable valve sleeve and can be opened or closed by the position of the valve sleeve. According to a further development, the by-pass passage is bent axially, inside the valve sleeve, in the direction of a fixed counter member and passes into this. As a result, there is the possibility of restricting the constriction in cross-section on closing of the valve to the transition from the valve sleeve to the counter member. The advantage of this measure consists in shifting the site of the greatest abrasion and erosion phenomena inside the by-pass passage to parts which can easily be replaced and which can be made favorable from the point of view of manufacture and service.

A valve for producing increases in pressure requires a throttle device inside the flow passage. In order to keep the flow passage penetrable during the time when no data are to be transmitted, the valve elements form an extension of the flow passage in the state of rest. They are, however, rotatable or displaceable and can be introduced into the flow passage to produce an increase in pressure, so as to constrict the cross-section there.

Embodiments of the present invention will now be described, by way of example, with reference to the accompanying drawings, in which.

Figure 1:
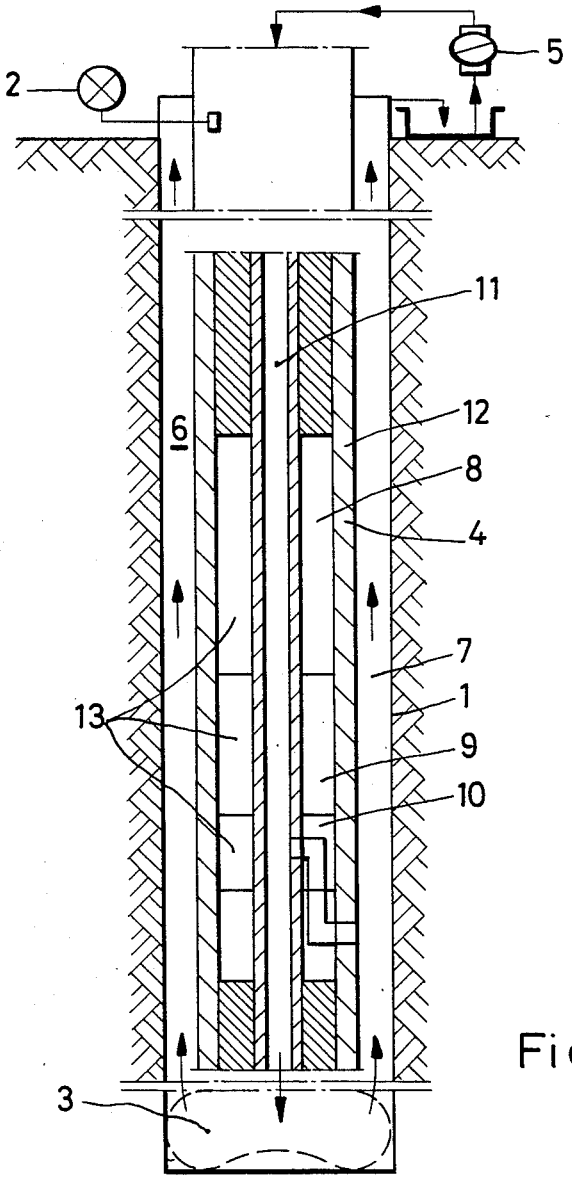
FIG. 1 shows diagrammatically the arrangement of apparatus in a drilling pipe string for the remote transmission of data.

FIG. 1 shows an apparatus for transmitting data as it is disposed inside a drilling pipe string 4 with a drill bit 3, which is in a borehole 1. The apparatus with devices 8, 9, 10 is inside a chamber 13 which is bounded on the inside by a flow passage 11 and on the outside by an outer tube 12. The apparatus consists at least of a suitable measuring instrument 8 which picks up the measured data, a data processing and control unit 9 and a valve arrangement 10. The transmission of information is effected via a flushing liquid 6 which is pumped, by means of a pump 5, downwards through the flow passage 11, through the drill bit 3 and upwards through an annular space 7, through changes in pressure in the flushing liquid 6 produced by the valve arrangement 10 to the surface of the earth and is there supplied by way of pressure-valve receivers to a measured-value readout unit 2.

Figure 2:
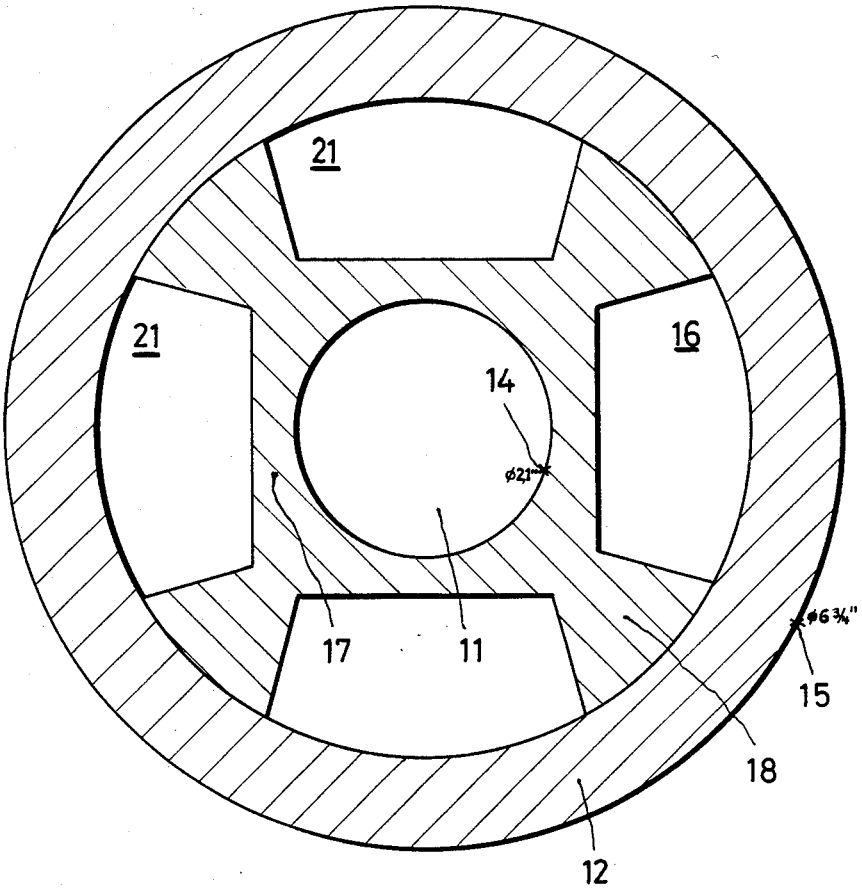
FIGS. 2, 3, 4 show cross-sections through a section of drilling pipe string which contains the apparatus, with various forms of installation chambers.
Figure 3:
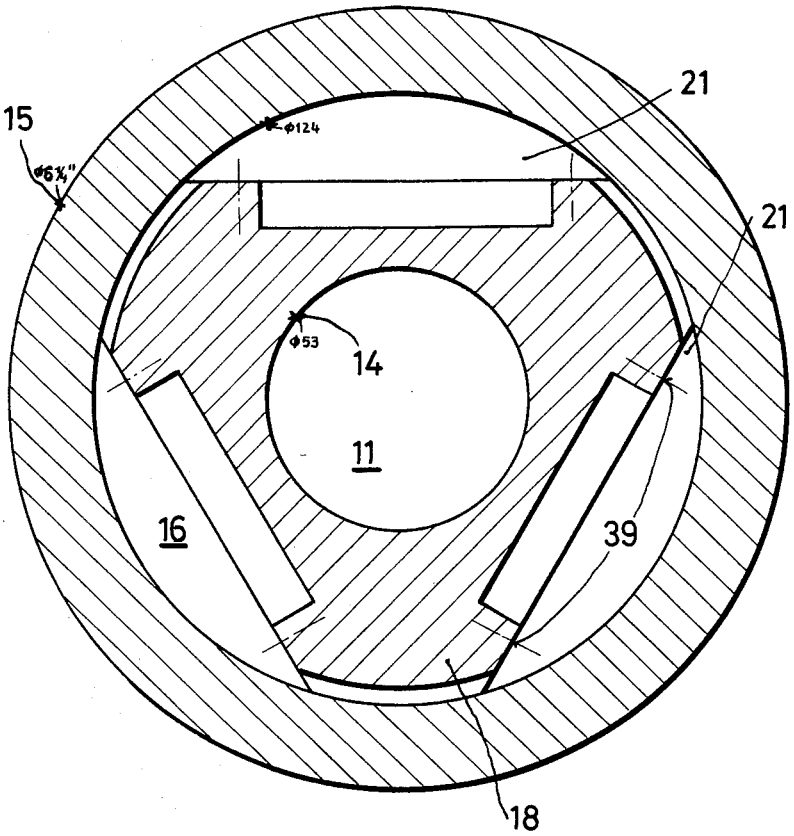
Figure 4:
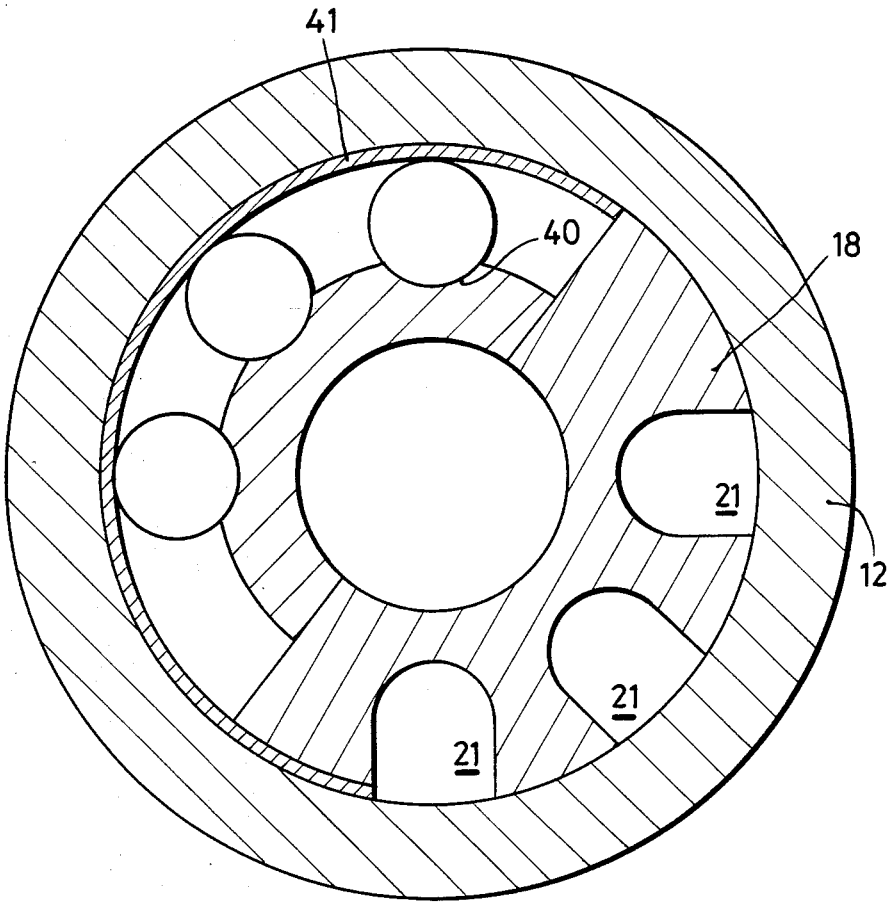

FIGS. 2, 3 and 4 show cross-sections through a pipe string which contains the apparatus for the remote transmission of information.

Common to all the figures is an outer tube 12 which embraces an insert 18. The insert 18 has a central bore which serves as a flow passage 11 for the flushing liquid pumped downwards. The flow passage 11 has an internal diameter 14 such as is generally usual with tools with an external diameter 15 in the deep-drilling art. In FIG. 2, for example, the diameter of the flow passage amounts to 2.1" with a tool diameter of 6¾".

The insert 18 is divided by machined grooves into a plurality of sectors 21 which, as a whole, form an installation chamber 16. The form of the installation chamber can be adapted to the structural elements to be inserted. Thus the installation chamber illustrated in FIG. 2 is particularly suitable for modular units such as measured-value receivers for example.

The embodiment illustrated in FIG. 3 lends itself for the mounting of printed circuit boards which can be secured to webs 39. Measuring points and adjusting means can be disposed at the side of the printed circuit board facing outwards so that they are freely accessible with the insert pulled out.

FIG. 4 illustrates two proposals for the arrangement of cylindrical components such as batteries or capacitors. In the version shown at the bottom right, the components can be inserted in the sectors 21 and be secured in the outer tube 12 when the insert 18 is pushed in. The version at the top left has a continuous installation chamber and the components are held in depressions 40 in the insert by means of a clamping ring 41 laid round them.

Figure 5:
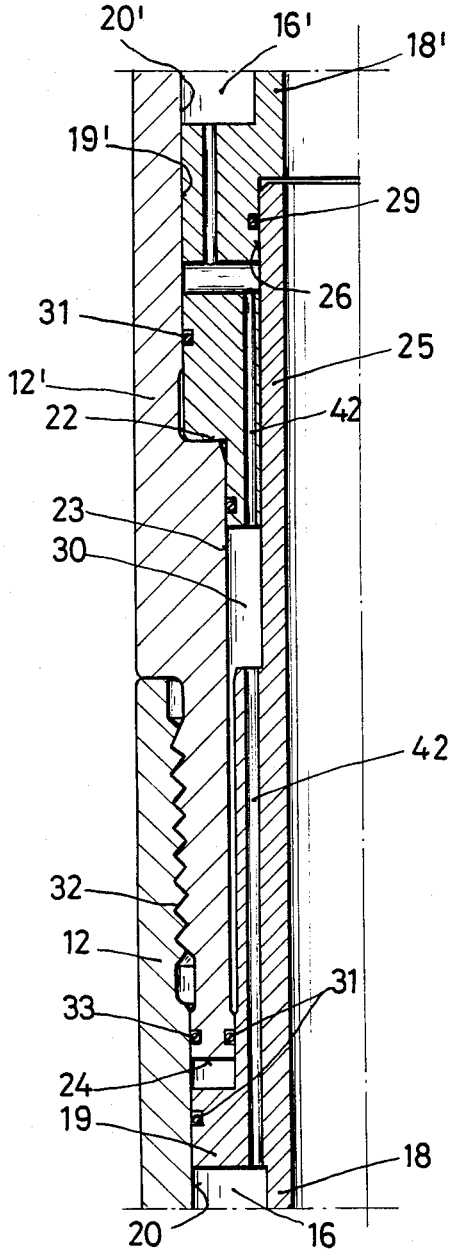
FIGS. 5 and 6 show longitudinal sections through a section of drilling pipe string which contains the apparatus with connecting pieces between adjacent inserts.

FIG. 5 shows a longitudinal section, restricted to one half, through a pipe string with a connecting piece between two inserts 18, 18' of the apparatus for remote transmission. The insert 18, disposed at the bottom, contains a cylindrical member 19 which bears against an inner wall 20 of a lower length of outer tube 12 and carries a sealing ring 31. The insert 18', disposed at the top, lies with its cylindrical member 19' against an inner wall 20' of an upper length of outer tube 12' and is supported axially against an end face 22 of the upper length of outer tube. The inserts 18, 18' are additionally sealed off from a threaded region 32 between the upper and lower lengths of outer tube 12, 12' by means of a sealing ring 33. An axial support of the insert 18, acting from above, could be effected by means of a threaded shoulder 24 of the upper length of outer tube 12'.

A connection between the upper and lower inserts 18, 18' with simultaneous separation from the flow passage 11 is represented by an extension 25 of the lower insert 18, which projects into a bore 26 in the upper insert, a seal 29 preventing penetration of flushing liquid into an intermediate chamber 30. This intermediate chamber 30 is sealed at the outer tube side by means of a seal 31. Through the measures shown in this figure, a connecting chamber, which is protected from penetrating flushing liquid, is provided between the installation chambers 16, 16' of the lower and upper inserts which can receive cables taken through bores 42 and the intermediate chamber 30. Cable connectors may advantageously be accommodated in the intermediate chamber 30.

Figure 6:
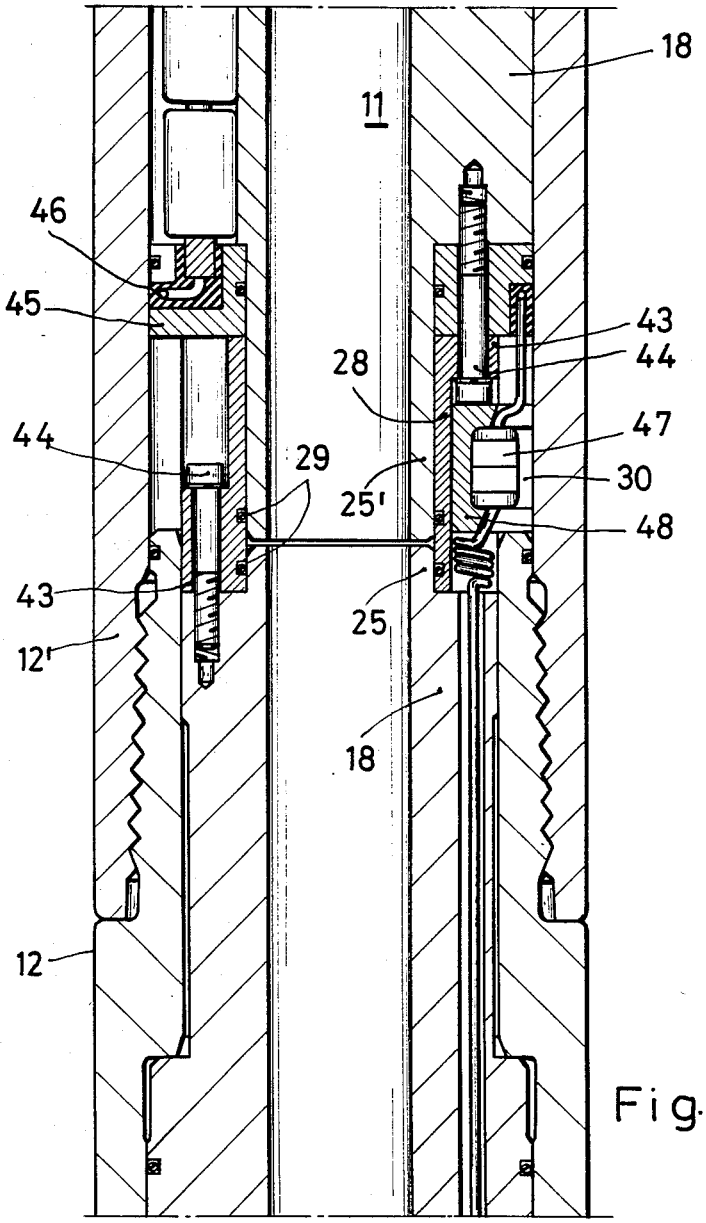

A longitudinal section through a second version of a connecting chamber between two inserts 18, 18' is illustrated in FIG. 6. In this case, both inserts have cylindrical extensions 25, 25' over which a cylindrical sleeve 28 is fitted and sealed off from the flow passage 11 by means of seals 29. The sleeve 28 is provided at both ends with flanges 43, 43 which in turn are secured, by means of screws 44, 44, to the upper and lower inserts 18, 18 respectively. Disposed between the upper flange 43' and the insert is an intermediate ring 45 which has a cable guide 46 cast integral therewith. The gap 30 between sleeve 28 and outer tube 12' serves to accommodate a cable connection 47, which is secured by a clamping member 48.

Figure 7:
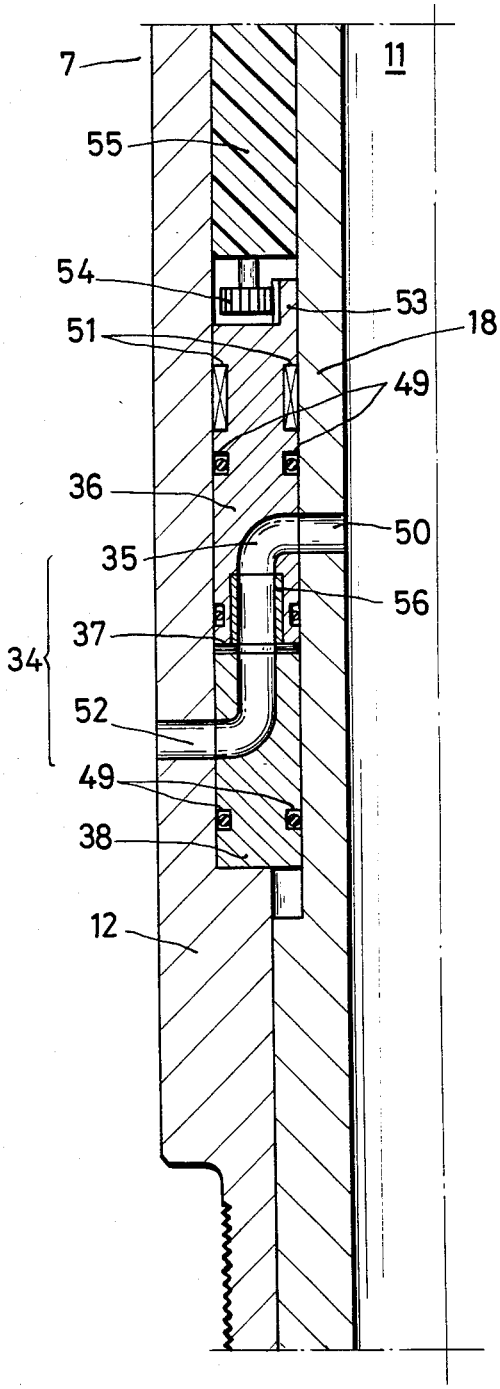
FIG. 7 shows a longitudinal section through a valve section of the apparatus for producing drops in pressure.

FIG. 7 shows a by-pass valve which opens or closes a by-pass 34, leading from the flow passage 11 to the annular space 7, depending on measured values to be transmitted. The by-pass passage leads radially through a bore 50 in the insert 18 into a valve sleeve 36, representing part of the by-pass passage 35 and mounted for rotation by means of bearings 51, there bends axially downwards and merges into a section, likewise extending axially, inside a fixed counter member 38. Inside the counter member the by-pass passage again bends radially outwards and leads through a bore 52 in the outer tube 12 to the annular space 7. At the upper end of the valve sleeve 36 is a toothed rim 53 in which a pinion 54 engages which in turn is actuated by a geared motor 55. In order that the throttling of the by-pass passage may occur only in the transition region between valve sleeve 36 and counter member 38 on turning of the valve sleeve, the transition from the bore 50 extending radially to the valve sleeve is constructed at least partially as a slot. Thus abrasion phenomena through the high velocity of flow of the flushing liquid occurring during the throttling are restricted to the transition from valve sleeve to counter member. The life of the heavily stressed parts can be increased by a hard metal insert member 56, here shown in the valve sleeve. Finally, seals 49, which are fitted at both generated surfaces of the valve sleeve and of the counter member, serve to seal off the by-pass passage.

Figure 8:
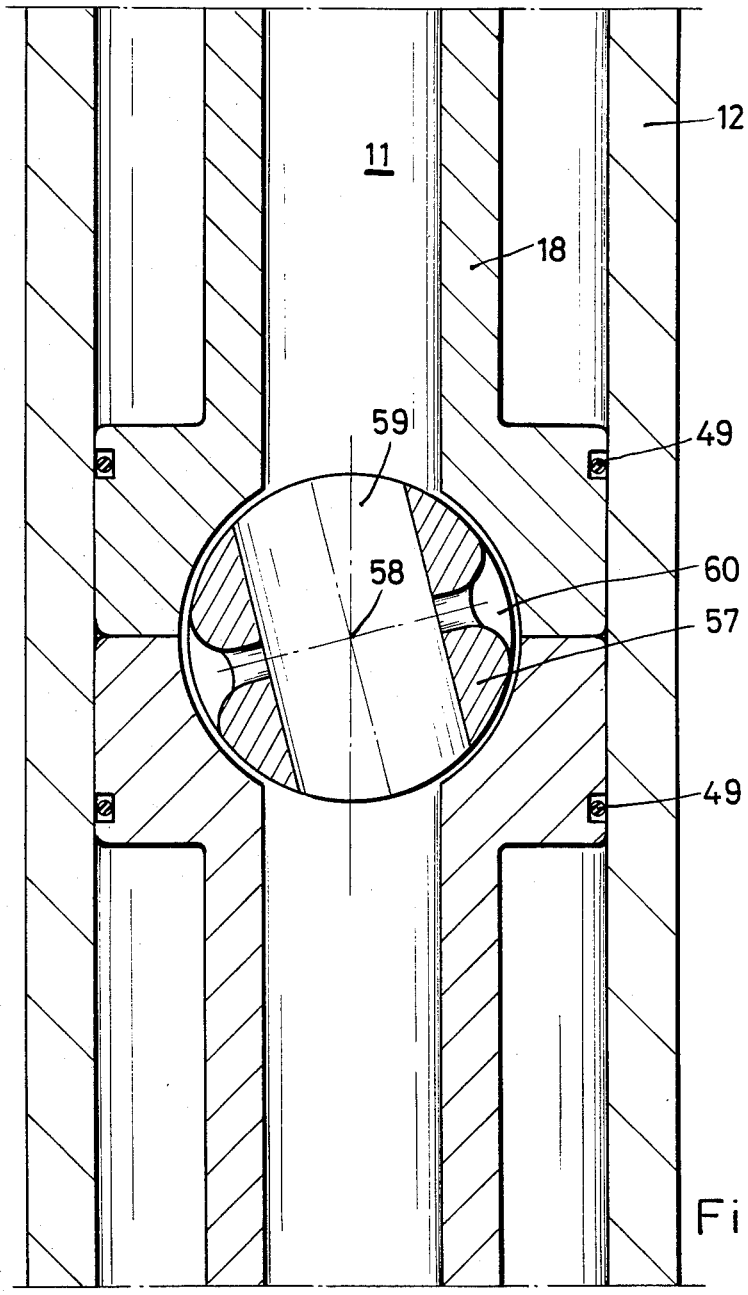
FIG. 8 shows a longitudinal section through a valve section of the apparatus for producing increases in pressure.

FIG. 8 shows a throttle arrangement in the flow passage constructed in the manner of a globe valve. The throttle arrangement comprises a valve body 57 which is mounted for rotation on an axis 58 perpendicular to the axis of the flow passage 11 and likewise perpendicular to the plane of the drawing. The valve body can be brought into a first position in which an internal section 59 of the flow passage is in alignment with the further flow passage 11. The throttle arrangement is then open. By turning through 90°, the valve body can be brought into a second position in which a throttle section 60 extends parallel to the flow passage 11. An intermediate position is represented in the drawing. As a result of a widening of the cross-section of the throttle arrangement 60 towards the outer periphery of the valve body 57, the effect is achieved that the opening phases of flow-passage section 59 and throttle section 60 overlap. A state in which the flow passage 11 is completely closed and consequently would cause dangerous pressure peaks is therefore not possible. In addition, a closing tendency through high velocity of flow of the flushing liquid and consequent build-up of reduced pressure (Bernoulli pressure and energy equalization) is compensated.

I claim:

1. Apparatus for transmitting data from a borehole to the surface of the earth during the operation of a drilling device which comprises a rotary drill bit, a drilling pipe string and a pump conveying a flushing liquid downwards in the flow passage of the drilling pipe string, through the rotary drill bit and upwards in the annular space of the borehole surrounding the drilling pipe string, the apparatus comprising devices disposed in the drilling pipe string to ascertain said data, to convert the data into a sequence of electrical control signals, and to produce pressure pulses in the downwardly directed flow of the flushing liquid, depending on the control signals, said devices being disposed inside chambers surrounding the flow passage of the drilling pipe string and bounded on the outside by an outer tube, said flow passage being a straight passage of constant diameter and normally unrestricted through its length whereby conventional tools can be passed through said apparatus for operation below said apparatus, and said apparatus including a rotatable valve member including a flow passage defined by a boundary wall, operation of said valve being effective to produce said pressure pulses.

2. Apparatus as claimed in claim 1, in which the internal diameter of the flow passage bounding the chamber corresponds to the usual value for the particular tool diameter.

3. Apparatus as claimed in claim 1 in which said valve member is mounted for rotation between the outer tube and the insert and bears with an end face against a fixed counter member and including a by-pass passage which, starting from the flow passage, enters the valve member radially through said insert, bends there axially in the direction of said counter member and passes into this and finally again bends radially and leads into the annular space through the outer tube.

4. Apparatus as in claim 1 in which said valve body is mounted for rotation on an axis extending perpendicular to the flow passage and said boundary walls comprise both a flow-passage section which can be brought into alignment with the flow passage and a throttle section which can be brought parallel to the flow passage.

* * * * *